US010151995B2

(12) United States Patent
Kojima

(10) Patent No.: US 10,151,995 B2
(45) **Date of Patent: *Dec. 11, 2018**

(54) IMAGE FORMING APPARATUS WITH ADJUSTABLE MIRROR FOR REFLECTING OPTICAL SCANNING BEAM

(71) Applicants: KABUSHIKI KAISHA TOSHIBA, Tokyo (JP); TOSHIBA TEC KABUSHIKI KAISHA, Tokyo (JP)

(72) Inventor: Takahiro Kojima, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/675,318

(22) Filed: Aug. 11, 2017

(65) Prior Publication Data

US 2017/0343924 A1 Nov. 30, 2017

Related U.S. Application Data

(63) Continuation of application No. 15/158,179, filed on May 18, 2016, now Pat. No. 9,760,035.

(30) Foreign Application Priority Data

Jul. 6, 2015 (JP) ..... 2015-135549

(51) Int. Cl.
*G03G 15/04* (2006.01)

(52) U.S. Cl.
CPC ..... *G03G 15/0409* (2013.01)

(58) Field of Classification Search
CPC ..... G03G 15/043; G03G 15/0435; G03G 15/04036; G03G 15/04045; G03G 15/04072; G03G 15/0409; B41J 2/435
See application file for complete search history.

(56) References Cited

U.S. PATENT DOCUMENTS

| | | | | |
|---|---|---|---|---|
| 5,963,240 | A | 10/1999 | Shinohara et al. | |
| 9,760,035 | B2 * | 9/2017 | Kojima ..... | G03G 15/0409 |
| 2009/0009836 | A1 | 1/2009 | Narita et al. | |
| 2009/0067020 | A1 | 3/2009 | Kojima et al. | |
| 2011/0310455 | A1 * | 12/2011 | Serizawa ..... | G03G 15/04036 359/207.11 |
| 2015/0309438 | A1 | 10/2015 | Kodo et al. | |

* cited by examiner

*Primary Examiner* — Sandra Brase
(74) *Attorney, Agent, or Firm* — Patterson & Sheridan, LLP

(57) ABSTRACT

In one embodiment, an image forming apparatus has a mirror which reflects an optical scanning beam toward a photoreceptor, so as to expose the photoreceptor. A rotating member makes contact with the mirror, at an end portion of the mirror, to support the mirror, and rotates, to perform swing adjustment of the mirror. A stopper engages with the rotating member, at a position except a position on a straight line passing through a rotating shaft line of the rotating member and a contact position of the rotating member and the mirror, seen from a rotating shaft direction of the rotating member, to fix a rotation position of the rotating member.

17 Claims, 10 Drawing Sheets

IMAGE FORMING APPARATUS WITH ADJUSTABLE MIRROR FOR REFLECTING OPTICAL SCANNING BEAM

CROSS-REFERENCE TO RELATED APPLICATIONS

This application is continuation of U.S. patent application Ser. No. 15/158,179, filed on May 18, 2016, which is based upon and claims the benefit of priority from the prior Japanese Patent Application No. 2015-135549, filed on Jul. 6, 2015, the entire contents of each of which are incorporated herein by reference.

FIELD

Embodiments described herein relate generally to an image forming apparatus.

BACKGROUND

There is an image forming apparatus which performs image forming using a toner. The image forming apparatus irradiates a photoreceptor drum with an optical scanning beam, to form an electrostatic latent image on the photoreceptor drum. The image forming apparatus develops the electrostatic latent image to form a toner image. For example, an image forming apparatus to form a full color image has a plurality of photoreceptor drums. The image forming apparatus irradiates on each of the photoreceptor drums with an optical scanning beam. Regarding toner images on the respective photoreceptor drums, it is necessary that they are accurately aligned so that the relative positions between the respective photoreceptor drums are not shifted. Particularly when the scanning positions of the optical scanning beams are not parallel with each other, an image quality may be deteriorated. The image forming apparatus has an adjustment mechanism of a mirror to reflect an optical scanning beam. The adjustment mechanism of the mirror supports the mirror which receives a pressing force from a pressing portion. The adjustment mechanism of the mirror has a mechanism to change a position of a projection portion to support the mirror. The adjustment mechanism of the mirror has sometimes a rotating cam and an engagement portion to fix the position of the rotating cam, as a mechanism to change the position of the projection portion. The engagement portion biases the rotating cam. The rotating cam is pressed from the mirror and the biased engagement portion. It is necessary that the rotating cam is rotated against a pressing force at the time of adjustment. Since the rotating cam receives the pressing force, the rotating cam is hard to rotate. When the rotating cam is forcedly rotated, the engagement portion or the like may be plastically deformed. When the engagement portion or the like is plastically deformed, the adjustment position of the rotating cam may go wrong.

DETAILED DESCRIPTION

According to one embodiment, an image forming apparatus exposes a photoreceptor, to form an electrostatic latent image on the photoreceptor, and develops the electrostatic latent image, to form an image. The image forming apparatus has a mirror, a rotating cam, and a stopper. The mirror reflects an optical scanning beam toward the photoreceptor, so as to expose the photoreceptor. The rotating cam makes contact with the mirror, at an end portion of the mirror, to support the mirror, and rotates, to change a tilt angle of the mirror. The stopper engages with the rotating cam, to fix a rotation position of the rotating cam. An engagement position of the stopper and the rotating cam is a position except a position on a straight line passing through a rotating shaft line of the rotating cam and a contact position of the rotating cam and the mirror, seen from a rotating shaft direction of the rotating cam.

Figure 1:
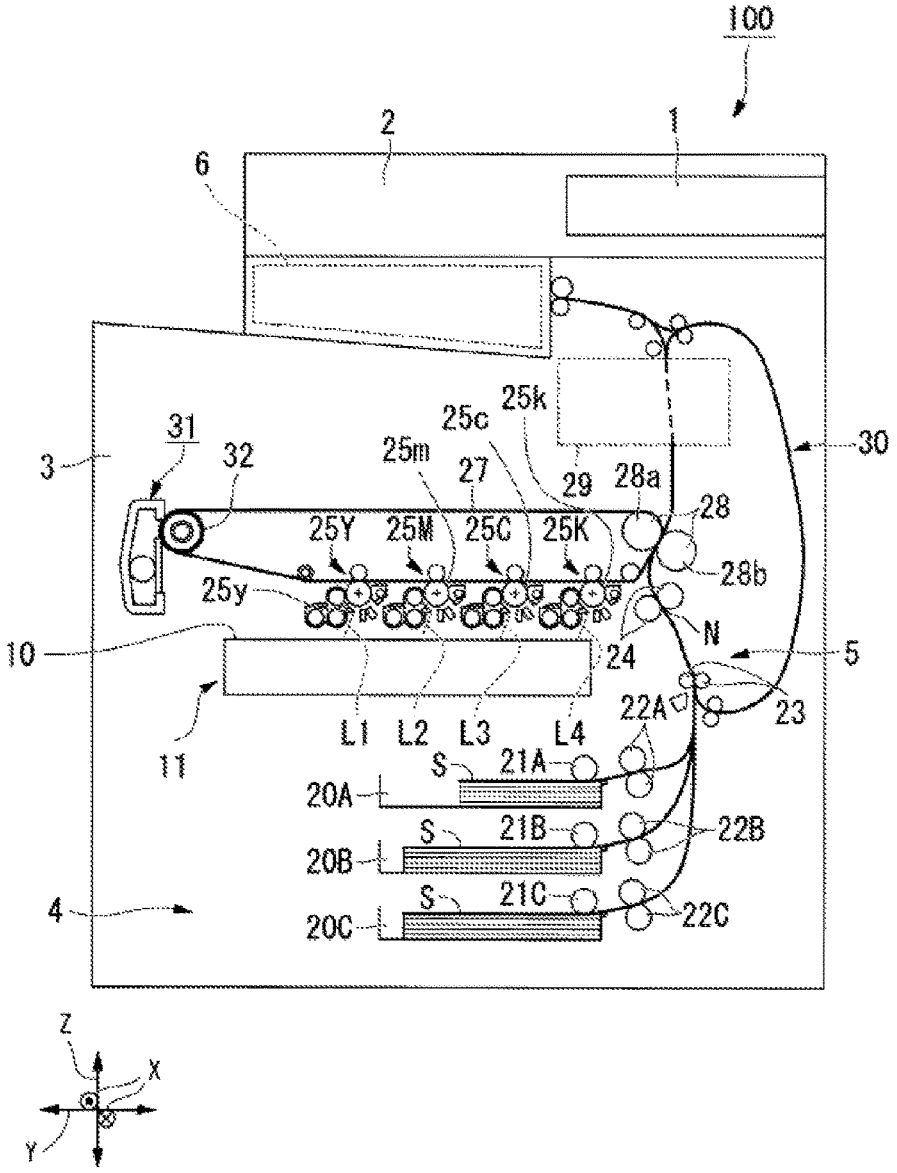
FIG. 1 is a sectional view schematically showing a whole configuration example of an image forming apparatus according to an embodiment.

Hereinafter, further embodiments will be described with reference to the drawings. In the drawings, the same symbols indicate the same or similar portions. FIG. 1 is a sectional view schematically showing a whole configuration example of an image forming apparatus 100 of an embodiment.

As shown in FIG. 1, the image forming apparatus 100 of the embodiment has a control panel 1, a scanner 2, a printer 3, a sheet feeding unit 4, a conveying unit 5, and a controller 6.

The control panel 1 accepts an input from an operator. The image forming apparatus 100 operates by this input. The scanner 2 reads image information of a copy object. The scanner 2 outputs the read image information to the printer 3. The printer 3 forms an output image (hereinafter, called a toner image), based on the image information to be read by the scanner 2, or image information from the outside, by a developing agent containing a toner and so on. The printer 3 transfers the toner image to a surface of a sheet S. The printer 3 applies heat and pressure to the toner image on the surface of the sheet S, to fix the toner image to the sheet S.

The sheet feeding unit 4 feeds sheets S one by one to the printer 3, in accordance with timing when the printer 3 forms the toner image. The sheet feeding unit 4 has a plurality of sheet feeding cassettes 20A, 20B, 20C. Each of the sheet feeding cassettes 20A, 20B, 20C houses sheets S of a size and a kind which are to be previously set to it. The sheet feeding unit 4 has pickup rollers 21A, 21B, 21C, and sheet feeding rollers 22A, 22B, 22C, corresponding to the respective sheet feeding cassettes 20A, 20B, 20C. The pickup rollers 21A, 21B, 21C pick up the sheets S one by one, from the respective sheet feeding cassettes 20A, 20B, 20C. Each of the sheet feeding rollers 22A, 22B, 22C feeds the above-described picked-up sheet S to the conveying unit 5.

The conveying unit 5 has a conveying roller 23, and a resist roller 24. The conveying roller 23 conveys the sheet S to be fed from the sheet feeding unit 4 to the resist roller 24. The conveying roller 23 abuts a leading edge of the sheet S in the conveying direction of the sheet S against a nip N of the resist roller 24. The sheet S which has been abutted bends. The sheet S bends, and thereby a position of the leading edge of the sheet in the conveying direction is aligned. That is, the resist roller 24 aligns the leading edge of the sheet S, in cooperation with the conveying roller 23. The resist roller 24 conveys the sheet S to a transfer unit 28 described later, in accordance with timing when the printer 3 transfers the toner image to the sheet S.

Next, a detailed configuration of the printer 3 will be described. The printer 3 has image forming units 25Y, 25M, 25C, 25K, a laser scanning unit 10, an intermediate transfer belt 27, the transfer unit 28, a fixing unit 29, and a transfer belt cleaning unit 31.

The image forming units 25Y, 25M, 25C, 25K form toner images on the intermediate transfer belt 27. The image forming units 25Y, 25M, 25C, 25K respectively have photoreceptor drums 25*y*, 25*m*, 25*c*, 25*k*. The image forming units 25Y, 25M, 25C, 25K respectively form toner images of yellow, magenta, cyan, black on the photoreceptor drums 25*y*, 25*m*, 25*c*, 25*k*. The photoreceptor drums 25*y*, 25*m*, 25*c*, 25*k* are arranged at intervals and in parallel with each other. The respective central axis lines of the photoreceptor drums 25*y*, 25*m*, 25*c*, 25*k* are arranged on the same horizontal plane. The respective central axis lines of the photoreceptor drums 25*y*, 25*m*, 25*c*, 25*k* are orthogonal to the conveying direction of the sheet S in the printer 3.

Around each of the photoreceptor drums 25*y*, 25*m*, 25*c*, 25*k*, a charger, a developer, a primary transfer roller, a cleaning unit, and a static eliminator which are well known are arranged. The primary transfer roller is opposite to the photoreceptor drum. The intermediate transfer belt 27 described later is arranged in the state to be sandwiched between the primary transfer rollers and the photoreceptor drums, respectively. The laser scanning unit 10 is arranged below the chargers and the developers.

The laser scanning unit 10 exposes the photoreceptor drums 25*y*, 25*m*, 25*c*, 25*k*, to form respective electrostatic latent images on the photoreceptor drums 25*y*, 25*m*, 25*c*, 25*k*. The laser scanning unit 10 irradiates surfaces of the photoreceptor drums 25*y*, 25*m*, 25*c*, 25*k* with laser beams L1, L2, L3, L4 (optical scanning beam), so as to expose the photoreceptor drums 25*y*, 25*m*, 25*c*, 25*k*, respectively. Image information of yellow, magenta, cyan, and black is supplied to the laser scanning unit 10, from the controller 6 described later. The laser beams L1, L2, L3, L4 are modulated based on the respective image information of yellow, magenta, cyan, and black. The laser beams L1, L2, L3, L4 scan on lines extending in the longitudinal directions of the photoreceptor drums 25*y*, 25*m*, 25*c*, 25*k*, on the surfaces of the photoreceptor drums 25*y*, 25*m*, 25*c*, 25*k*, respectively. The laser beams L1, L2, L3, L4 which scan the surfaces of the photoreceptor drums 25*y*, 25*m*, 25*c*, 25*k* eliminate the exposed portions, respectively. The laser beams L1, L2, L3, L4 form electrostatic latent images on the surfaces of the photoreceptor drums 25*y*, 25*m*, 25*c*, 25*k*, in accordance with the image information. A detailed configuration of the laser scanning unit 10 will be described later.

The intermediate transfer belt 27 is an endless belt. A plurality of rollers make contact with the inner circumferential surface of the intermediate transfer belt 27. The above-described plurality of rollers give a tension to the intermediate transfer belt 27. The intermediate transfer belt 27 is elliptically stretched, by a support roller 28*a* and a transfer belt roller 32, along with the above-described plurality of rollers. The support roller 28*a* makes contact with the inner circumferential surface of the intermediate transfer belt 27, at the vicinity of the conveying path of the conveying unit 5. The transfer belt roller 32 makes contact with the inner circumferential surface of the intermediate transfer belt 27, at a side opposite to the contact position of the support roller 28*a* and the intermediate transfer belt 27. That is, the transfer belt roller 32 and the support roller 28*a* are arranged to be opposite to each other. The support roller 28*a* functions as a part of the transfer unit 28 described later. The transfer belt roller 32 rotationally drives the intermediate transfer belt 27.

At the lower surface side in the drawing of the intermediate transfer belt 27, the image forming units 25Y, 25M, 25C, 25K except the above-described primary transfer rollers are arranged in this order. The image forming units 25Y, 25M, 25C, 25K are arranged at intervals to each other, in an area between the transfer belt roller 32 and the support roller 28*a*, as shown in FIG. 1.

The developers of the image forming units 25Y, 25M, 25C, 25K house developing agents containing toners of yellow, magenta, cyan, black, respectively. The respective developers develop the electrostatic latent images on the photoreceptor drums 25*y*, 25*m*, 25*c*, 25*k*. As a result of this, toner images are respectively formed on the photoreceptor drums 25*y*, 25*m*, 25*c*, 25*k*. The respective primary transfer rollers of the image forming units 25Y, 25M, 25C, 25K transfer (primarily transfer) the toner images on the surfaces of the photoreceptor drums 25*y*, 25*m*, 25*c*, 25*k* onto the intermediate transfer belt 27. When the toner images reach primary transfer positions, primary transfer biases are given to the primary transfer rollers, respectively. Each of the cleaning units of the image forming units 25Y, 25M, 25C, 25K removes the non-transferred toner on the surface of the photoreceptor drum after primary transfer, by scraping it. The static eliminators of the image forming units 25Y, 25M, 25C, 25K irradiate the surfaces of the photoreceptor drums after passing through the cleaning units with a lights, respectively. The static eliminators eliminate the photoreceptor drums 25*y*, 25*m*, 25*c*, 25*k*, respectively.

The transfer unit 28 has the support roller 28*a* and a secondary transfer roller 28*b*. The secondary transfer roller 28*b* and the support roller 28*a* are opposite to each other, while sandwiching the intermediate transfer belt 27 therebetween. The sheet S is conveyed between the sandwiched intermediate transfer belt 27 and the secondary transfer roller 28*b*, by the conveying unit 5. A position where the secondary transfer roller 28*a* and the intermediate transfer belt 27 make contact with each other is a secondary transfer position. The transfer unit 28 transfers (secondarily transfer) the toner image on the intermediate transfer belt 27 to the sheet S, at the secondary transfer position. The transfer unit 28 applies a secondary transfer bias to the secondary transfer roller 28*b*, in accordance with timing when the sheet S is conveyed to the secondary transfer position, for example. The transfer unit 28 transfers the toner image on the intermediate transfer belt 27 to the sheet S, by the secondary transfer roller 28*b* to be applied with the secondary transfer bias.

The fixing unit 29 gives heat and pressure to the sheet S. The fixing unit 29 fixes the toner image which has been transferred to the sheet S, with the heat and pressure. The transfer belt cleaning unit 31 is arranged outside the intermediate transfer belt 27. The transfer belt cleaning unit 31 is opposite to the transfer belt roller 32. The transfer belt cleaning unit 31 sandwiches the intermediate transfer belt 27. The transfer belt cleaning unit 31 scrapes the toner on the surface of the intermediate transfer belt 27. The transfer belt cleaning unit 31 collects the scraped toner in a waste toner tank.

The printer 3 has an inversion unit 30. The inversion unit 30 conveys again the sheet S whose front and back have been inverted to a position in front of the resist roller 24 in the conveying path of the conveying unit 5. The inversion unit 30 conveys again the sheet S whose front and back have been inverted to the position in front of the resist roller 24, so as to form an image on the rear surface of the sheet S. The controller 6 controls the respective unit portions of the image forming apparatus 100.

Figure 2:
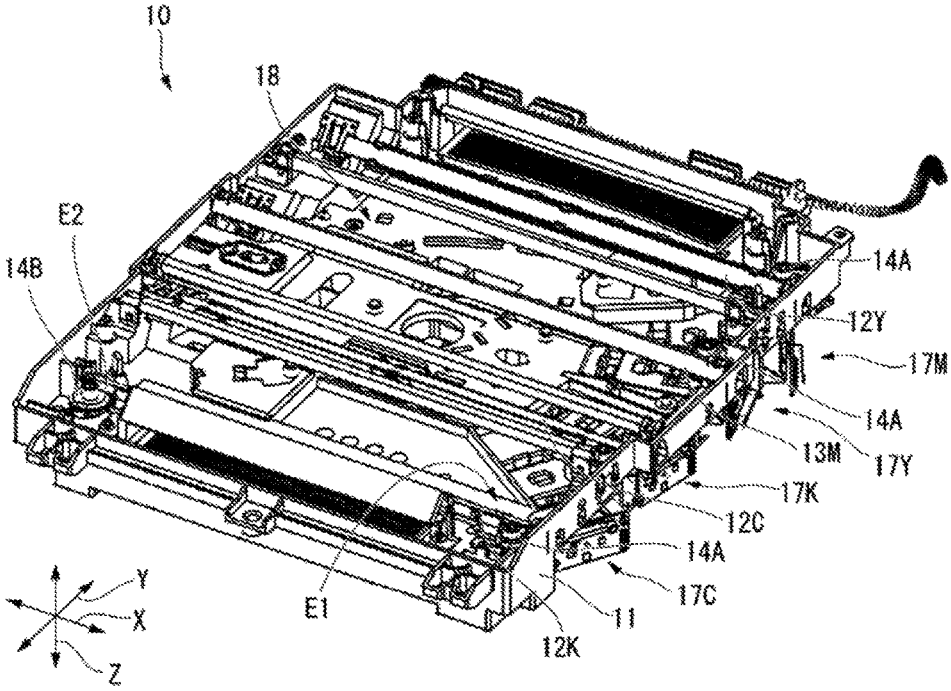
FIG. 2 is a perspective view schematically showing a configuration example of the laser scanning unit of the image forming apparatus according to the embodiment.
Figure 3:
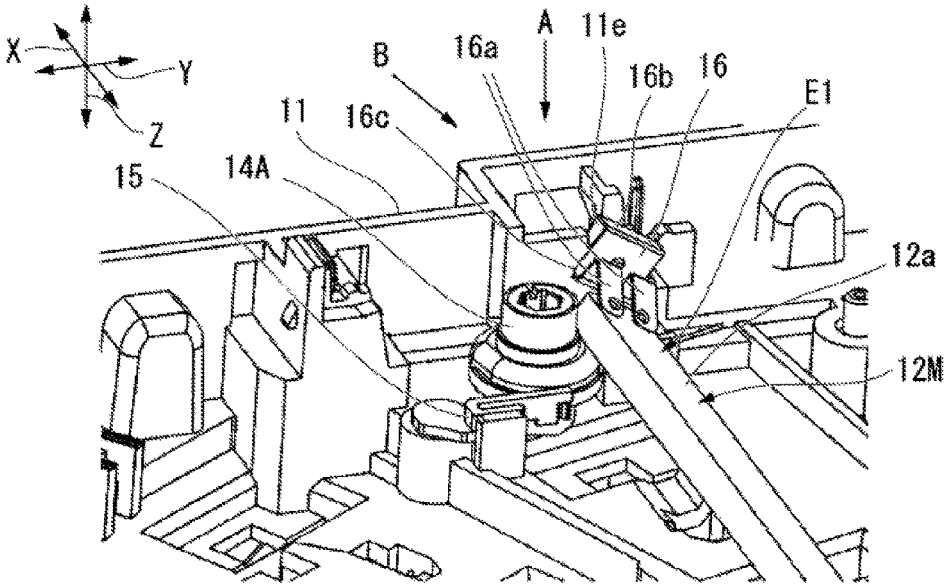
FIG. 3 is a perspective view schematically showing an example of a support form of the first end portion of the mirror of the image forming apparatus according to the embodiment.
Figure 4:
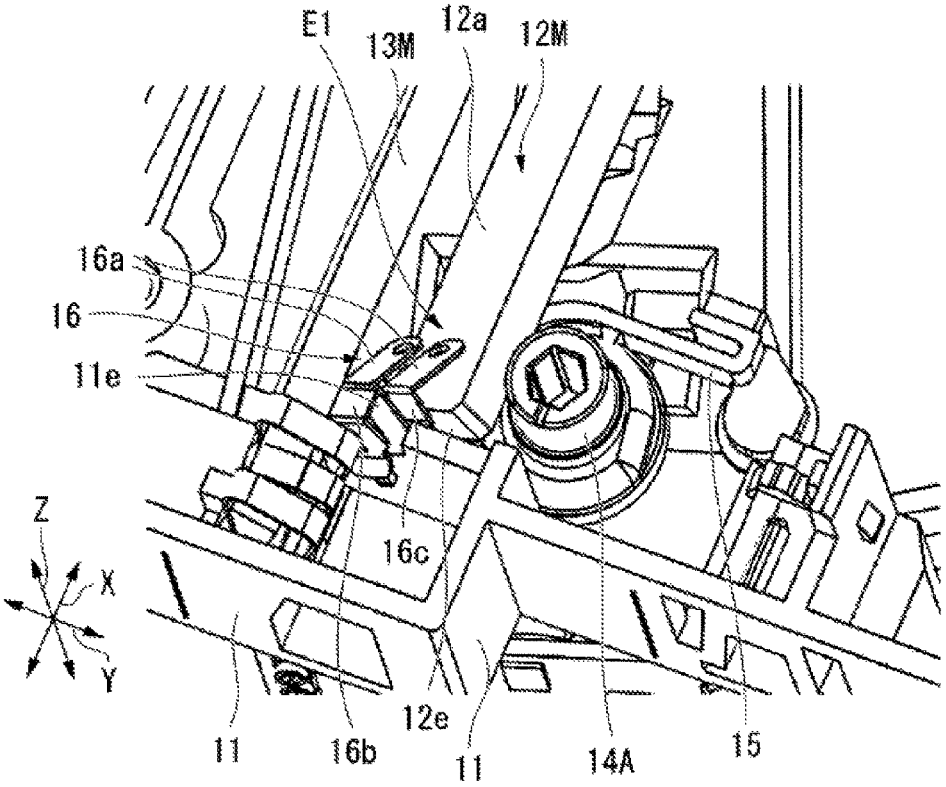
FIG. 4 is a perspective view showing the example of the support form of the first end portion of the mirror seen from a B direction in FIG. 3.
Figure 5:
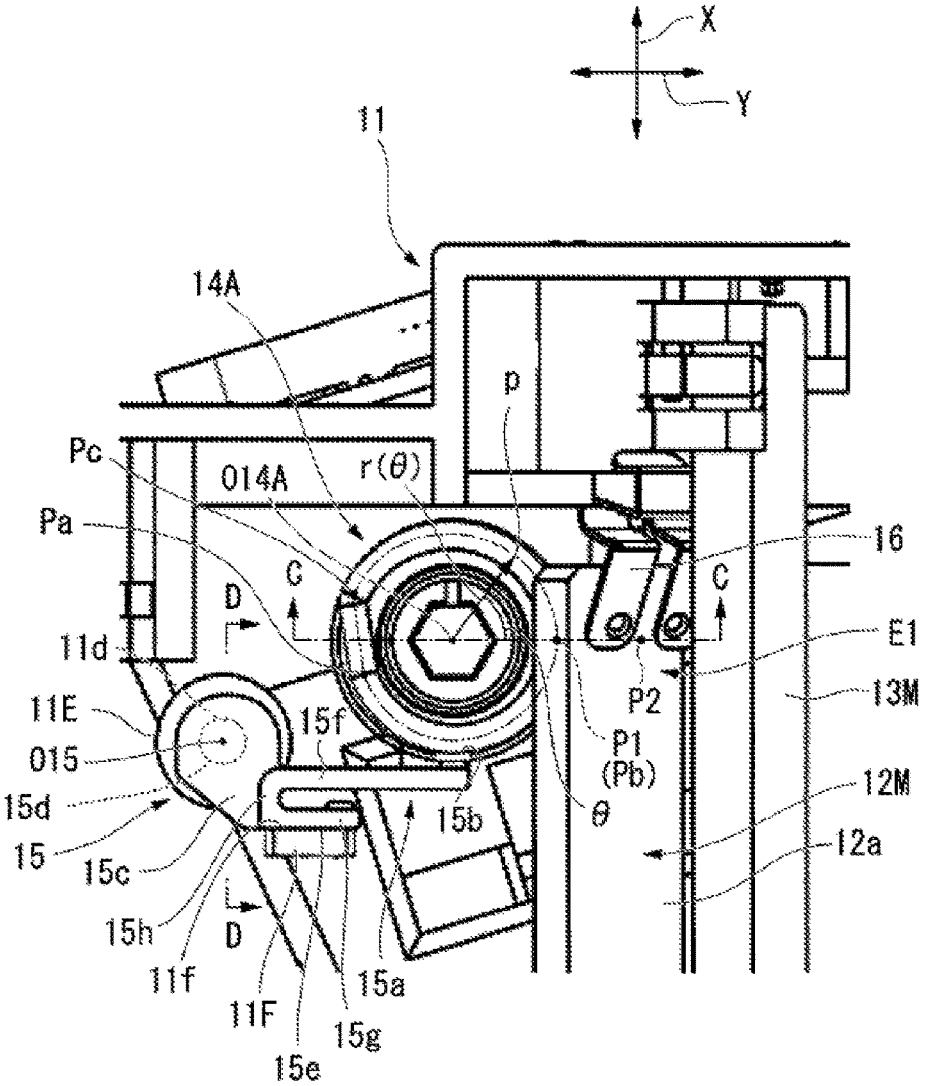
FIG. 5 is a plan view showing the example of the support form of the first end portion of the mirror seen from an A direction in FIG. 3.
Figure 6:
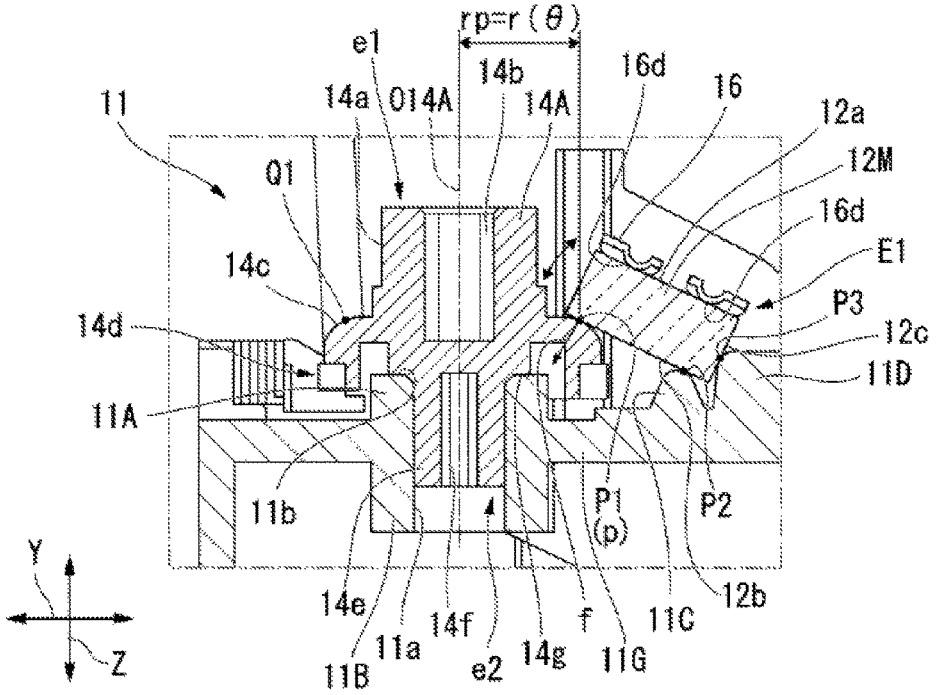
FIG. 6 is a C-C sectional view in FIG. 5.
Figure 7:
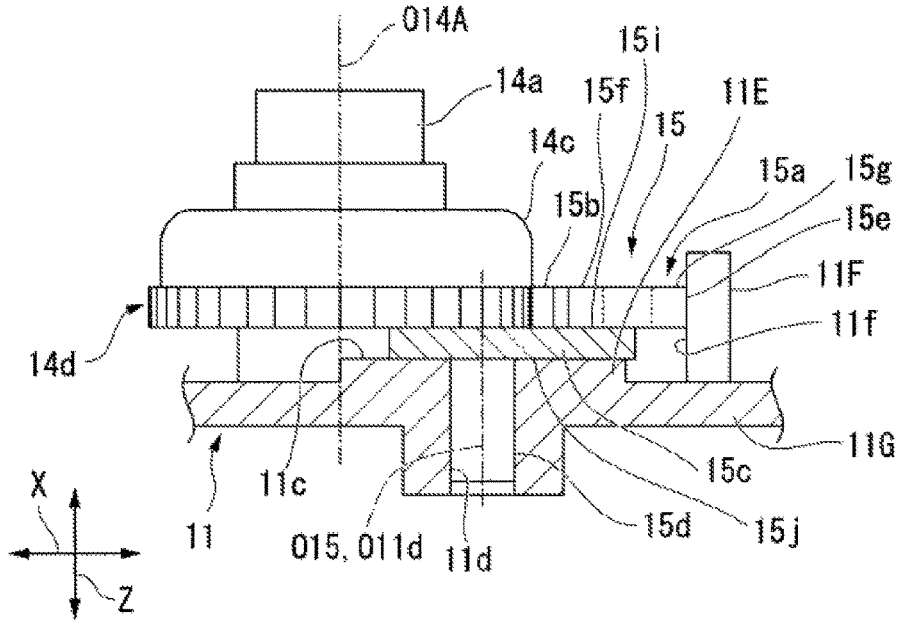
FIG. 7 is a D-D sectional view in FIG. 5.
Figure 8:
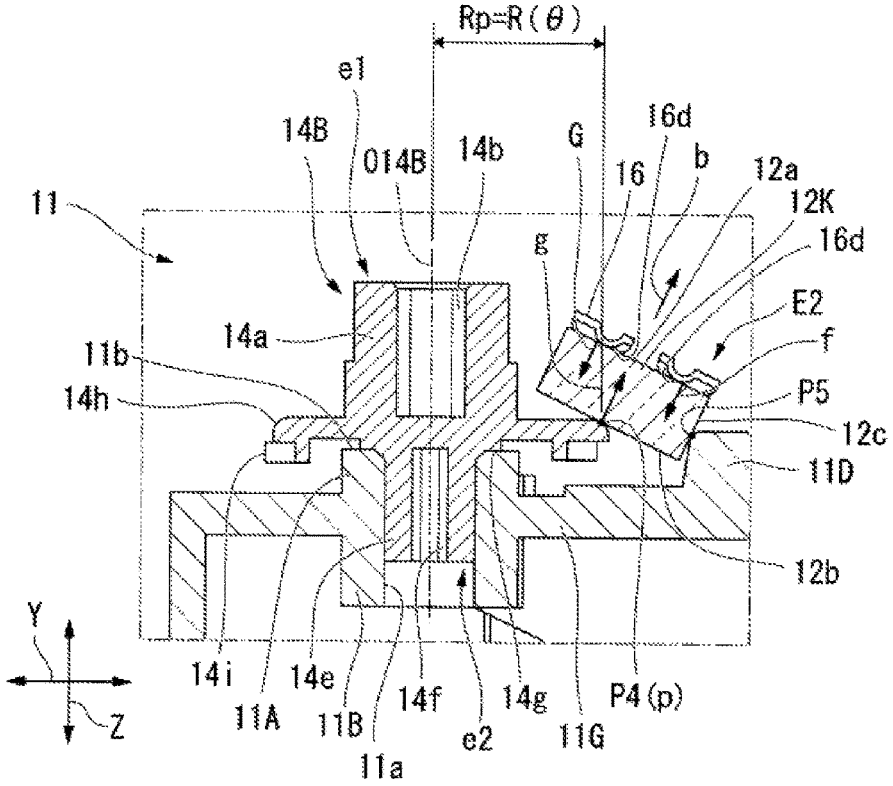
FIG. 8 is a sectional view schematically showing an example of a support form of the second end portion of the mirror of the image forming apparatus according to the embodiment.

A configuration of a main portion of the laser scanning unit 10 will be described. FIG. 2 is a perspective view schematically showing a configuration example of the laser scanning unit 10 of the image forming apparatus 100 of the embodiment. FIG. 3 is a perspective view schematically showing an example of a support form of a first end portion E1 of the mirror of the image forming apparatus 100 of the embodiment. FIG. 4 is a perspective view seen from a B direction in FIG. 3. FIG. 5 is a plan view seen from an A direction in FIG. 3. FIG. 6 is a C-C sectional view in FIG. 5. FIG. 7 is a D-D sectional view in FIG. 6. FIG. 8 is a sectional view schematically showing an example of a support form of a second end portion E2 of the mirror of the image forming apparatus 100 of the embodiment.

As shown in FIG. 2, the laser scanning unit 10 has a housing 11, laser units 17Y, 17M, 17C, 17K, a write optical system 18. The laser scanning unit 10 shown in FIG. 2 is in a state that an upper cover thereof has been removed. Hereinafter, when a direction and a relative position in the laser scanning unit 10 are described, the description will be made based on the arrangement of the laser scanning unit 10 when it is assembled in the image forming apparatus 100. FIG. 2 is a perspective view of the laser scanning unit 10 in the arrangement when it is assembled in the image forming apparatus 100.

When directions in the laser scanning unit 10 are described, an X direction, a Y direction, a Z direction are sometimes used. The X direction is a direction in which ideal scanning lines of the laser beams L1, L2, L3, L4 respectively extend on the photoreceptor drums 25*y*, 25*m*, 25*c*, 25*k*. The X direction coincides with a direction in which the rotating shafts of the photoreceptor drums 25*y*, 25*m*, 25*c*, 25*k* extend. The Y direction is a direction orthogonal to the X direction on the horizontal plane. The Z direction is a vertical direction. The Z direction is orthogonal to the X direction and the Y direction. A virtual plane whose normal line extends in the X direction is sometimes called a YZ plane. A virtual plane whose normal line extends in the Y direction is sometimes called a ZX plane. A virtual plane whose normal line extends in the Z direction is sometimes called an XY plane.

The housing 11 fixes the laser units 17Y, 17M, 17C, 17K, the write optical system 18 in a definite position relation. The housing 11 is covered with a cover not shown in the drawing. Openings for transmitting the laser beams L1, L2, L3, L4 are formed in the cover to cover the upper portion of the housing 11. Each of the laser units 17Y, 17M, 17C, 17K has a laser diode (hereinafter, called an LD), and a drive circuit for the LD. Laser lights generated by the laser units 17Y, 17M, 17C, 17K are made to be parallel beams by collimator lenses of the write optical system 18 described later. The laser units 17Y, 17M, 17C, 17K are fixed to one side surface of the housing 11 in the X direction.

The write optical system 18 is fixed to the housing 11. The write optical system 18 has a collimator lens, a cylindrical lens, a polygon motor, an fθ lens, and a plurality of mirrors, which are well known. Laser lights generated by the LDs of the laser units 17Y, 17M, 17C, 17K are made to be parallel beams by the collimator lenses, respectively. Hereinafter, each optical path in the write optical system 18 will be briefly described. The respective optical paths are different only in the layout on the housing 11, and are approximately the same. Accordingly, symbols thereof will be omitted, except when an optical path of a specific laser beam is particularly referred to. When describing a direction in a cross section orthogonal to an optical axis of the each laser beam, a main scanning direction and a sub scanning direction are sometimes used. The main scanning direction is a direction in which the laser beam moves by the rotation of a polygon mirror in the polygon motor. The sub scanning direction is a direction orthogonal to the main scanning direction. The main scanning direction in an image surface of the each laser beam is the X direction. The sub scanning direction in an image surface of the each laser beam is the Y direction.

The cylindrical lens images each laser beam from the laser unit, on the polygon mirror of the polygon motor described later in the sub scanning direction. The cylindrical lens is arranged between the laser unit and the polygon motor. The polygon motor has a rotating shaft extending in the Z direction, and a well-known polygon mirror fixed to the rotating shaft. The polygon mirror is rotated by the polygon motor, to perform deflection scanning of the each laser beam. When reflected by the polygon mirror, each laser beam diverges in the sub scanning direction. The fθ lens images the each laser light reflected from the polygon mirror on the photoreceptor drum. The fθ lens has an fθ characteristic. The fθ lens makes each laser beam which is to be scanned at an equal angle by the polygon motor, to be scanned on the image surface at a constant speed.

Between the polygon motor and the fθ lens, and between the fθ lens and the photoreceptor drum, a plurality of the mirrors extending in the X direction are located. The each mirror reflects the each laser beam in an appropriate direction. The each mirror leads the each laser beam on the each photoreceptor drum. In the present embodiment, the four mirrors are arranged on the each optical path. These mirrors are called a first mirror, a second mirror, a third mirror, and a fourth mirror, from the polygon mirror side toward the photoreceptor drum side. Though not particularly shown in the drawings, in the present embodiment, the first mirrors and the second mirrors in the optical paths of the laser beams L1, L2 (refer to FIG. 1) are common. The first mirrors and the second mirrors in the optical paths of the laser beams L3, L4 (refer to FIG. 1) are common.

In FIG. 2, a fourth mirror 12Y (mirror) reflects the laser beam L1 not shown in the drawing to the upper side of the laser scanning unit 10. The fourth mirror 12Y leads the laser beams L1 to the photoreceptor drum 25*y* not shown in the drawing. A third mirror 13M reflects the laser beam L2 not shown in the drawing to the lower side of the third mirror 13M. The third mirror 13M leads the laser beams L2 to a fourth mirror 12M (mirror, refer to FIG. 4) described later. In FIG. 2, the fourth mirror 12M (mirror) not shown in the drawing reflects the laser beam L2 not shown in the drawing to the upper side of the laser scanning unit 10. The fourth mirror 12M leads the laser beams L2 to the photoreceptor drum 25*m* not shown in the drawing. A fourth mirror 12C (mirror) reflects the laser beam L3 to the upper side of the laser scanning unit 10. The fourth mirror 12C leads the laser beams L3 to the photoreceptor drum 25*c* not shown in the drawing. A fourth mirror 12K (mirror) reflects the laser beam L4 not shown in the drawing to the upper side of the laser scanning unit 10. The fourth mirror 12K leads the laser beams L4 to the photoreceptor drum 25*k* not shown in the drawing.

The fourth mirrors 12Y (12M, 12C, 12K) extend in approximately parallel with each other (including a parallel case), and are fixed to the housing 11. The fourth mirrors 12Y (12M, 12C, 12K) extend in the X direction. Each of the fourth mirrors 12Y (12M, 12C, 12K) is supported at two points which are separate in the short direction, at the first end portion E1 near each of the laser unit 17Y (17M, 17C, 17K) in the longitudinal direction. Each of the fourth mirrors 12Y (12M, 12C, 12K) is supported at one point of the central portion in the short direction, at the second end portion E2 at an opposite side to the first end portion E1 in the longitudinal direction.

The fourth mirror 12K is supported from below at the first end portion E1, by a first rotating cam 14A, and a projection portion (not shown in the drawing) in the housing 11. The fourth mirror 12K is supported from below at the second end portion E2, by a second rotating cam 14B. The fourth mirror 12Y is supported from below at the first end portion E1, by the first rotating cam 14A and a projection portion (not shown in the drawing) in the housing 11. The fourth mirror 12Y is supported from below at the second end portion E2, by a projection portion (not shown in the drawing) in the housing 11. The fourth mirror 12C is supported in the same manner as the fourth mirror 12Y, by the first rotating cam 14A and so on not shown in FIG. 2. The fourth mirror 12M not shown in FIG. 2 is supported in the same manner as the fourth mirror 12Y, by the first rotating cam 14A and so on not shown in the drawing.

The support form of the fourth mirror by the first rotating cam 14A is the same in any of the fourth mirrors 12Y, 12M, 12C, 12K. In the following, an example of a case in which the first rotating cam 14A supports the fourth mirror 12M will be described. As shown in FIG. 3 to FIG. 7, a presser spring 16 (first pressing member) and the first rotating cam 14A make contact with the first end portion E1 of the fourth mirror 12M. The fourth mirror 12M is arranged on a plate-like portion 11G extending horizontally inside the housing 11, in a posture that a reflection surface 12*a* thereof faces upward. As shown in FIG. 6, a support projection 11C and the first rotating cam 14A support from below a rear surface 12*b* of the fourth mirror 12M at the first end portion E1. A side surface 12*c* of the fourth mirror 12M in the short direction is locked by a locking projection 11D formed in the vicinity of the support projection 11C.

The support projection 11C projects upward from the plate-like portion 11G. A tip portion of the support projection 11C in the projecting direction is rounded so as to make point contact with (refer to a point P2) the rear surface 12*b* of the fourth mirror 12M. The support projection 11C becomes a fulcrum at the time of performing swing adjustment of the fourth mirror 12M, as described later. In the present embodiment, as shown in FIG. 5, a virtual line connecting points P1, P2 extends in the Y direction, when seen from the Z direction. In the present embodiment, the virtual line connecting the points P1, P2 passes through a central axis line O14A which becomes a rotating shaft line of the first rotating cam 14A described later, when seen from the Z direction.

As shown in FIG. 6, the locking projection 11D projects upward from the plate-like portion 11G. A tip portion of the locking projection 11D in the projecting direction is rounded so as to make point contact with (refer to a point P3) the side surface 12*c* of the fourth mirror 12M. The locking projection 11D regulates the movement of the fourth mirror 12M in the short direction for performing swing adjustment of the fourth mirror 12M, as described below.

As shown in FIG. 3, and FIG. 4, the presser spring 16 is a plate spring formed by bending a metal plate. The presser spring 16 presses the reflection surface 12*a* from above the fourth mirror 12M. The shape of the presser spring 16 is not particularly limited, if it can bias the fourth mirror 12M by an elastic force thereof. In the present embodiment, the presser spring 16 has a base end portion 16*b*, an intermediate curved portion 16*c*, tip plate-like portions 16*a*. The base end portion 16*b*, the intermediate curved portion 16*c*, and the tip plate-like portions 16*a* are connected in this order.

The base end portion 16*b* is a portion which has been bent in a ⊐ shape (a U shape), so as to sandwich a locking portion 11*e* projecting upward from the housing 11. A method in which the base end portion 16*b* is fixed to the locking portion 11*e* is not particularly limited. For example, the base end portion 16*b* may be fixed to the locking portion 11*e* by screwing. In the present embodiment, a locking hole not shown in the drawing is provided in the base end portion 16*b*. A locking projection not shown in the drawing which is to engage with this locking hole projects from the locking portion 11*e* of the housing 11. When the locking projection of the locking portion 11*e* is inserted in the locking hole of the base end portion 16*b*, the position of the base end portion 16*b* to the locking portion 11*e* is fixed.

The intermediate curved portion 16*c* is a U-shaped curved portion which can be inserted between the locking portion 11*e* and an end surface 12*e* (refer to FIG. 4) of the fourth mirror 12M in the longitudinal direction.

The tip plate-like portions 16*a* are branched into two portions from the intermediate curved portion 16*c*. The tip plate-like portions 16*a* are bent toward the reflection surface 12*a* of the fourth mirror 12M. A hemispherical convex portion 16*d* (refer to FIG. 6) is provided at a tip of each of the tip plate-like portions 16*a*. Each of the tip plate-like portions 16*a* makes contact with the reflection surface 12*a* by the convex portion 16*d*.

When in the presser spring 16, the base end portion 16*b* is locked by the locking portion 11*e*, the convex portions 16*d* make contact with the reflection surface 12*a*. At this time, the intermediate curved portion 16*c* and the tip plate-like portions 16 bend from the natural state. An elastic restoring force generated by this elastic deformation acts on the fourth mirror 12M from the convex portions 16*d*. The presser spring 16 presses the reflection surface 12*a* of the fourth mirror 12M toward the rear surface 12*b* of the fourth mirror 12M.

As shown in FIG. 6, the first rotating cam 14A has a first shaft portion 14*a*, a second shaft portion 14*e*, a first cam portion 14*c*, a first concave-convex portion 14*d*.

The first shaft portion 14*a* is formed at a first end portion e1 of the first rotating cam 14A. The first shaft portion 14*a* extends along the central axis line O14A (rotating shaft line). In the present embodiment, the central axis line O14A extends in the Z direction. At the center of the first shaft portion 14*a*, an adjustment jig engagement hole 14*b* extends coaxially with the first shaft portion 14*a*. The adjustment jig engagement hole 14*b* extends from the first end portion e1 in the first rotating cam 14A toward a second end portion e2 on the opposite side. Regarding the shape of the adjustment jig engagement hole 14*b*, it is possible to employ an appropriate shape in accordance with a shape of an adjustment jig to be inserted. For example, in the present embodiment, the adjustment jig has a hexagonal key at a tip portion thereof. The adjustment jig engagement hole 14*b* has a hexagonal hole to engage with the hexagonal key.

The second shaft portion 14*e* extends from the end portion of the first shaft portion 14*a* to the second end portion e2 of the first rotating cam 14A. The second shaft portion 14*e* is a columnar shaft portion which extends coaxially with the first shaft portion 14*a*. The external diameter of the second shaft portion 14*e* is smaller than the external diameter of the first shaft portion 14*a*. A step portion 14*g* is formed between the first shaft portion 14*a* and the second shaft portion 14*e*. The step portion 14*g* is a plane orthogonal to the central axis line O14A.

The second shaft portion 14*e* is inserted from above into a bearing portion 11*a* at the center of a boss portion 11A projecting from the housing 11 in the same direction as the support projection 11C. The bearing portion 11*a* is a circular hole which penetrates through the boss portion 11A in the Z direction. The inner diameter of the bearing portion 11*a* is larger than the second shaft portion 14*e*, so that the second shaft portion 14*e* can be rotatably fitted therein. A thrust receiving surface 11*b* that is an end surface of the boss portion 11A in the projecting direction makes slidably contact with the step portion 14*g* in the first rotating cam 14A. In the housing 11, a boss portion 11B which is coaxial with the boss portion 11A projects in a direction opposite to the projecting direction of the boss portion 11A. The bearing portion 11*a* penetrates through the inside of the boss portion 11B. The size of a projection height of the boss portion 11B is such a size that the second shaft portion 14*e* can be housed inside the bearing portion 11*a*.

At the center of the second shaft portion 14*e*, an adjustment jig engagement hole 14*f* extends coaxially with the second shaft portion 14*e*. The adjustment jig engagement hole 14*f* extends from the second end portion e2 in the first rotating cam 14A toward the first end portion e1. Regarding the shape of the adjustment jig engagement hole 14*f*, it is possible to employ an appropriate shape in accordance with a shape of an adjustment jig to be inserted. For example, in the present embodiment, the adjustment jig has a hexagonal key at the tip portion thereof. Accordingly the adjustment jig engagement hole 14*f* has a hexagonal hole to engage with the hexagonal key.

The adjustment jig engagement hole 14*f* may have the same shape as the adjustment jig engagement hole 14*b*, or may have a different shape. In the present embodiment, as an example, the hole diameter (inscribed circle diameter of the hexagonal hole) of the adjustment jig engagement hole 14*f* is smaller than the hole diameter of the adjustment jig engagement hole 14*b*. The adjustment jig engagement hole 14*f* may penetrate to the inside of the adjustment jig engagement hole 14*b*, or may not penetrate to it. FIG. 6 shows, as an example, a case in which the adjustment jig engagement hole 14*f* does not penetrate to the adjustment jig engagement hole 14*b*.

The first cam portion 14*c* is extended outside from the outer circumferential portion in the vicinity of the step portion 14g, in the first shaft portion 14*a*. FIG. 5 shows an outer shape of the first cam portion 14*c* seen from the rotating shaft direction (Z direction) of the first rotating cam 14A. Regarding the outer shape of the first cam portion 14*c*, a radius from the central axis line O14A spirally changes around the central axis line O14A. As shown in FIG. 6, in the cross section including the central axis line O14A, the outer circumferential portion of the first cam portion 14*c* is rounded in the shape of an arc. The first cam portion 14*c* makes point contact with the rear surface 12*b* of the fourth mirror 12M, at the rounded position thereof. The contact point of the rear surface 12*b* and the first cam portion 14*c* is indicated by the point P1.

The first cam portion 14*c* is supported rotatably around the central axis line O14A, by the bearing portion 11*a*. When the first cam portion 14*c* rotates around the central axis line O14A, points where the first cam portion 14*c* makes contact with the rear surface 12*b* are connected on the first cam portion 14*c*, a curve Pa Pb Pc shown by a chain double-dashed line in FIG. 5 is obtained. The point Pa is a point where a distance r from the central axis line O14A becomes a minimum value rmin. The point Pc is a point where the distance r from the central axis line O14A becomes a maximum value rmax (here, rmax>rmin). The point Pb is a point where the distance r from the central axis line O14A becomes (rmin+rmax)/2. For example, a rotation angle at the point Pb is made to be 0, and the counterclockwise direction shown in the drawing is determined as the positive direction of a rotation angle θ. A rotation angle at the point Pa is made to be −θa (here, θa>0), and a rotation angle at the point Pc is made to be +θc (here, θc>0). If a distance rp from the central axis line O14A at an optional point p on the curve Pa Pb Pc is expressed as rp=r(θ) (here, $-\theta a \leq \theta \leq_{+} \theta c$), the function r(θ) is a monotonously increasing function. At the point Pc, rp=rmax. If the rotation angle θ further increases from the point Pc, the distance rp gradually decreases. At the point Pa, rp=rmin.

The first concave-convex portion 14*d* is formed on the circumference around the central axis line O14A, in the first rotating cam 14A. The first concave-convex portion 14*d* can engage with a stopper 15 described later. When the stopper 15 engages with the first concave-convex portion 14*d*, the rotation position of the first rotating cam 14A is fixed. The first concave-convex portion 14*d* may be formed at any position except the first cam portion 14*c*, in the first rotating cam 14A. In the present embodiment, the first concave-convex portion 14*d* is formed adjacent to the first cam portion 14*c*, near the second end portion e2, as an example (refer to FIG. 6, FIG. 7).

Regarding the shape of the first concave-convex portion 14*d*, an appropriate concave-convex shape can be employed such that it can engage with the stopper 15 described later, at a plurality of positions separate in the circumferential direction. In the first concave-convex portion 14*d*, concave portions and convex portions are alternately formed in the circumferential direction. An interval of the engagement positions of the first concave-convex portion 14*d* and the stopper 15 is not particularly limited, if a resolution of the rotation position required for the swing adjustment of the fourth mirror 12M described later is obtained. However, in order to suppress a force for releasing the engagement of the first concave-convex portion 14*d* and the stopper 15 described later, a shape of the convex portion is preferably made to be a mountain shape which becomes gradually narrower toward an apex. A shape of the concave portion is preferably made to be a valley shape which becomes gradually narrower toward a bottom portion. In the present embodiment, as an example of the shape of the first concave-convex portion 14*d*, a shape of a spur gear is employed in which gear teeth of an appropriate module are continuously formed.

As shown in FIG. 5, the stopper 15 is arranged in the housing 11. The stopper 15 engages with the first concave-convex portion 14*d* of the first rotating cam 14A. The stopper 15 engages with the first concave-convex portion 14*d*, to fix the rotation position of the first rotating cam 14A. The stopper 15 has an engagement portion 15*b* (a first engagement portion), an elastic support portion 15*a* (an elastic portion), a base portion 15*c*, and a locking pin 15*d*. In the present embodiment, the material of the stopper 15 is a synthetic resin, as an example. However, the material of the stopper 15 may be metal, or a composite material of metal and a synthetic resin.

The engagement portion 15*b* is engaged with the concave portion of the first concave-convex portion 14*d*. In the present embodiment, the first concave-convex portion 14*d* has a spur gear tooth form. The engagement portion 15*b* has a spur gear tooth form of the same module as the first concave-convex portion 14*d*.

The elastic support portion 15*a* supports the engagement portion 15 reciprocably between an engagement position and an engagement release position. The engagement position is a position where the engagement portion 15*b* engages with the first concave-convex portion 14*d* of the first rotating cam 14A without backlash. The engagement release position is a position where the engagement portion 15*b* is disengaged from the concave portion in the first concave-convex portion 14*d*, and the engagement with the first concave-convex portion 14*d* in the circumferential direction is released. The elastic support portion 15*a* is elastically deformed at least when it moves from the engagement position to the engagement release position. However, the elastic support portion 15*a* may be elastically deformed at the engagement position. In this case, the elastic support portion 15*a* biases the engagement portion 15*b* toward the central axis line O14A by its elastic restoring force.

In the present embodiment, the elastic support portion 15*a* is a J-shaped member. The elastic support portion 15*a* has an arm portion 15*f*, a locking portion 15*g*, a curved portion 15*h*. The arm portion 15*f* extends straight in a natural state in which an external force does not act on it. The locking portion 15*g* is a plate-like portion which is extended shorter than the arm portion 15*f*. The locking portion 15*g* is in parallel with the arm portion 15*f*. The curved portion 15*h* connects end portions of the arm portion 15*f* and the locking portion 15*g*. In the locking portion 15*g*, a locking surface 15*e* is formed on a surface thereof at a side opposite to the arm portion 15*f*. The locking surface 15*e* performs detent of the stopper 15, in a state in which the stopper 15 is assembled in the housing 11.

The engagement portion 15*b* of the present embodiment is formed, at an end portion at a side opposite to the curved portion 15*h*, in the longitudinal direction of the arm portion 15*f*. Further, the engagement portion 15*b* of the present embodiment is formed on a surface that is a side opposite to the locking portion 15*g*, on the surface of the arm portion 15*f* in the thickness direction. Hereinafter, the end portion at a side opposite to the curved portion 15*h*, in the longitudinal direction of the arm portion 15*f*, is sometimes called a tip portion of the arm portion 15*f*. In addition, an end portion at the curved portion 15*h* side, in the longitudinal direction of the arm portion 15*f*, is sometimes called a base portion of the arm portion 15*f*.

As shown in FIG. 7, the base portion 15*c* is a plate-like portion so that the stopper 15 is loaded on the housing 11. The curved portion 15*h* and the locking portion 15*g* of the elastic support portion 15*a* are formed, on a first surface 15*i* (an upper surface shown in FIG. 7) of the base portion 15*c*. The first surface 15*i* is one surface of the base portion 15*c* in the plate thickness direction. The arm portion 15*f* connecting to the curved portion 15*h* extends from the curved portion 15*h* on the first surface 15*i* toward the outside of the base portion 15*c*. The locking pin 15*d* projects from a second surface 15*j* (a lower surface shown in FIG. 7) of the base portion 15*c*. The second surface 15*j* is the other surface of the base portion 15*c* in the plate thickness direction.

A pedestal portion 11E and a locking projection 11F are formed on the plate-like portion 11G of the housing 11. The pedestal portion 11E and the locking projection 11F are used for assembling the stopper 15 in the housing 11. The base portion 15*c* of the stopper 15 is loaded on the pedestal portion 11E. The pedestal portion 11E projects upward from the plate-like portion 11G. As shown in FIG. 5, a plane shape of the pedestal portion 11E is circular. An insertion hole 11*d* penetrates through a central portion of the pedestal portion 11E in the Z direction. The locking pin 15*d* is inserted into the insertion hole 11*d*. The locking pin 15*d* of the stopper 15 is rotatably fitted in the insertion hole 11*d*. The second surface 15*j* of the base portion 15*c* tightly adheres to a thrust receiving surface 11*c* formed at the upper portion of the pedestal portion 11E. In the state that the locking pin 15*d* is inserted in the insertion hole 11*d*, the arm portion 15*f* is held at a height to face the first concave-convex portion 14*d* of the first rotating cam 14A.

As shown in FIG. 7, the locking projection 11F projects upward from the plate-like portion 11G in the vicinity of the pedestal portion 11E. The locking projection 11F is higher than the thrust receiving surface 11*c* of the pedestal portion 11E. A locking surface 11*f* is formed on the side surface of the locking projection 11F. The locking surface 11*f* locks the locking surface 15*e* of the stopper 15 in which the locking pin 15*d* has been inserted in the insertion hole 11*d*. The locking surface 11*f* is a plane in parallel with the YZ plane. The distance from the central axis line of the insertion hole 11*d* to the locking surface 11*f* is equal to the distance from a central axis line O15 of the locking pin 15*d* to the locking surface 15*e* in the stopper 15. When the locking surface 15*e* of the stopper 15 is locked by the locking surface 11*f*, the locking portion 15*g* takes a posture in parallel with the YZ plane. The rotation of the stopper 15 around the central axis line O15 in the clockwise direction shown in FIG. 5 is locked by the locking portion 15*g*. The arm portion 15*f* of the stopper 15 takes a posture in parallel with the YZ plane, at at least the base portion thereof. In this state, the engagement portion 15*b* is engaged with the first concave-convex portion 14*d* of the first rotating cam 14A. In the present embodiment, the engagement portion 15*b* faces the central axis line O14A of the first rotating cam 14A in the X direction.

At the above-described engagement position, the arm portion 15*f* may extend in the Y direction until the tip portion. Or, the tip portion of the arm portion 15*f* may be bent to a side opposite to the first concave-convex portion 14*d* in the X direction. When the arm portion 15*f* extends in the Y direction until the tip portion, the arm portion 15*f* is not elastically deformed. Since being not elastically deformed, the elastic support portion 15*a* does not bias the engagement portion 15*b* toward the first concave-convex portion 14*d*. In the present embodiment, as an example, the arm portion 15*f* is formed in such a shape that the tip portion of the arm portion 15*f* is bent to a side opposite to the first concave-convex portion 14*d* in the X direction. That is, in the state that the stopper 15 has been assembled, the distance between the central axis line O14A and the arm portion 15*f* is smaller than the external diameter of the first concave-convex portion 14*d*. In this case, the arm portion 15*f* is elastically deformed. The arm portion 15*f* biases the engagement portion 15*b* at the tip portion toward the first concave-convex portion 14*d*. The bent amount of the arm portion 15*f* is determined in consideration of the easiness of the adjustment work described later.

In the above, the support form of the fourth mirror 12M at the first end portion E1 has been described. The support form of the fourth mirror 12M at the second end portion E2 is different from that of the first end portion E1, in a point that the fourth mirror 12M is supported at one point by a projection portion not shown in the drawing. The rear surface 12*b* at the second end portion E2 is supported by one projection portion. However, the support position (contact position) by the projection portion may be a central portion of the rear surface 12*b* in the short direction. The support position of the projection portion may be near the end portion in the short direction. The projection portion which makes contact with the rear surface 12*b* at the second end portion E2 may be a projection portion formed to project from the plate-like portion 11G similarly as the support projection 11C. The projection portion which makes contact with the rear surface 12*b* at the second end portion E2 may be formed such that the projected height can be fixed after the projected height has been changed. However, the second end portion E2 of the fourth mirror 12M may be supported by the second rotating cam 14B, in the same manner as the fourth mirror 12K described later.

The reflection surface 12*a* of the fourth mirror 12M is pressed to the rear surface 12*b* side at the second end portion E2, by an appropriate pressing member not shown in the drawing. As the pressing member at the second end portion E2, the same presser spring 16 as the case in the first end portion E1 may be used. The side surface 12*c* of the fourth mirror 12M is similarly locked by the same locking portion as the locking projection 11D at the first end portion E1.

Next, a support form of the fourth mirror 12K at the second end portion E2 by the second rotating cam 14B will be described. As shown in FIG. 8, in the support form by the second rotating cam 14B, the support projection 11C in the support form (refer to FIG. 6) by the above-described first rotating cam 14A does not exist. Further, in the support form by the second rotating cam 14B, the second rotating cam 14B is used, in place of the first rotating cam 14A. The reflection surface 12*a* of the fourth mirror 12K is pressed by the presser spring 16 (second pressing member), in the same manner as the support form by the above-described first rotating cam 14A. In FIG. 8, though the illustration is omitted, the engagement portion 15*b* (second engagement portion) of the stopper 15 is engaged with the second rotating cam 14B, in the same manner as the support form by the above-described first rotating cam 14A. Hereinafter, a point different from the support form by the above-described first rotating cam 14A will be mainly described.

The second rotating cam 14B has the first shaft portion 14*a* and the second shaft portion 14*e* in the same manner as the first rotating cam 14A, along a central axis line O14B of the second rotating cam 14B. In the first shaft portion 14*a* and the second shaft portion 14*e*, the adjustment jig engagement holes 14*b*, 14*f* are respectively formed, in the same manner as the first rotating cam 14A. The second rotating cam 14B has a second cam portion 14*h*, a second concave-convex portion 14*i*, in place of the first cam portion 14*c*, the first concave-convex portion 14*d* of the first rotating cam 14A, respectively. In the plate-like portion 11G, the boss portions 11A, 11B and the bearing portion 11*a* which are the same as described above are formed in the vicinity of the second end portion E2 of the fourth mirror 12K. The second shaft portion 14*e* is inserted into the bearing portion 11*a*, and thereby the second rotating cam 14B is assembled in the housing 11.

The second cam portion 14*h* makes contact with the rear surface 12*b* at a point P4 at the central portion thereof in the short direction (refer to FIG. 8). The point P4 is a contact point with the fourth mirror 12K at the second end portion E2 of the fourth mirror 12K. The position of the second cam portion 14*h* in the first shaft portion 14*a* in the axial direction is different from the position of the first cam portion 14*c*. When points where the second cam portion 14*h* makes contact with the rear surface 12*b* are connected on the second cam portion 14*h*, a curve in which a distance Rp from the central axis line O14B changes in accordance with the rotation angle θ around the central axis line O14B is drawn. The distance Rp can be expressed as Rp=R(θ), for example. Here, θ indicates the same rotation angle, as in the function r(θ) in the first cam portion 14*c*. The function R(θ) may be the same as the function r(θ) in the first cam portion 14*c*. The function R(θ) may be different from the function r(θ) in the first cam portion 14*c*. When the function R(θ) is different from the function r(θ), a change amount of Rp per the same rotation angle may be changed according to the necessity of the adjustment sensitivity. When the function R(θ) is different from the function r(θ), a maximum value Rmax, and a minimum value Rmin of Rp may be different from rmax, rmin, respectively. Or, they may be made such that Rmax−Rmin≠rmax−rmin.

The second concave-convex portion 14*i* may have a pitch circle diameter different from that of the first concave-convex portion 14*d*, in accordance with the shape or the size of the second cam portion 14*h*. In the present embodiment, the second concave-convex portion 14*i* has a spur gear tooth form having the similar module to the first concave-convex portion 14*d* The engagement portion 15*b* of the stopper 15 can also engage with the second concave-convex portion 14*i*. In the present embodiment, the engagement portion 15*b* of the stopper 15 engages with the second concave-convex portion 14*i*, as the second engagement portion.

Next, an operation of the image forming apparatus 100 will be described with reference to FIG. 1. In the image forming apparatus 100, an instruction to perform image forming is inputted from the control panel 1 or from the outside to the controller 6. The controller 6 makes the printer 3 start image forming. The printer 3 feeds a sheet S of an appropriate size from the sheet feeding unit 4 to the resist roller 24. The printer 3 forms latent images on the photoreceptor drums 25*y*, 25*m*, 25*c*, 25*k*, by the laser scanning unit 10. That is, the laser scanning unit 10 emits the laser beams L1, L2, L3, L4 modulated based on the image information. The laser beams L1, L2, L3, L4 are condensed by the write optical system 18. The laser beams L1, L2, L3, L4 respectively scan the surfaces of the photoreceptor drums 25*y*, 25*m*, 25*c*, 25*k* by the action of the write optical system 18 (refer to FIG. 1).

In this manner, electrostatic latent images corresponding to the respective image information are formed on the photoreceptor drums 25*y*, 25*m*, 25*c*, 25*k*. The image forming units 25Y, 25M, 25C, 25K develop the electrostatic latent images formed on the photoreceptor drums 25*y*, 25*m*, 25*c*, 25*k* by the developers of the colors, respectively. Toner images of the colors corresponding to the electrostatic latent images are formed, on the surfaces of the photoreceptor drums 25*y*, 25*m*, 25*c*, 25*k*, respectively.

Each of the toner images is primarily transferred to the intermediate transfer belt 27 by each of the primary transfer rollers. At this time, the primary transfer timings are appropriately shifted, in accordance with the arrangement positions of the image forming units 25Y, 25M, 25C, 25K. The respective toner images are sequentially superposed in accordance with the movement of the intermediate transfer belt 27, without causing color shift. Each of the toner images is sent to the transfer unit 28. The toner image which reaches the transfer unit 28 is transferred to the sheet S which has been conveyed from the resist roller 24 to the transfer unit 28. The transferred toner image is fixed to the sheet S by the fixing unit 29. The sheet S to which the toner image has been fixed is discharged outside the image forming apparatus 100. The transfer residual toner which has remained on the sheet S without being transferred by the transfer unit 28 is scraped by the transfer belt cleaning unit 31. The intermediate transfer belt 27 is reusably cleaned. In this way, image forming to a sheet S is finished.

In the image forming apparatus 100, the laser beams L1, L2, L3, L4 scan on the target scanning lines, if there are not manufacturing errors or arrangement errors in the optical components on the respective optical paths. However, it is impossible to completely eliminate a manufacturing error or an arrangement error of the optical component. The scanning lines of the laser beams L1, L2, L3, L4 deviate sometimes from the target scan positions. In the image forming apparatus 100, an adjustment to respectively align the scanning lines of the laser beams L1, L2, L3, L4 with the target positions is performed, at least when the laser scanning unit 10 is assembled.

In order to align the scanning lines of the laser beams L1, L2, L3, L4 with the target positions, tilt angles of the fourth mirrors 12Y, 12M, 12C, 12K are adjusted, respectively. In the present embodiment, "a swing adjustment" to adjust a scan position of the scanning line of each of the laser beams L1, L2, L3, L4 in the scan direction is performed. In the swing adjustment, a tilt angle of the each fourth mirror on the YZ plane is adjusted, using the first rotating cam 14A at the each first end portion E1. The parallel shifting of a scanning line to the target scanning line is corrected by a timing control of the electrostatic latent image forming which the controller 6 performs.

In the present embodiment, "a tilt adjustment" to adjust a tilt of the scanning line of each of the laser beams L1, L2, L3, L4 is performed. In the tilt adjustment, a tilt angle of the fourth mirror 12K in the ZX plane is adjusted, using the second rotating cam 14B at the second end portion E2 of the fourth mirror 12K. A tilt of the scanning line of the laser beam L4 becomes an adjustment reference for tilts of the scanning lines of the laser beams L1, L2, L3. The tilt adjustments of the scanning lines of the laser beams L1, L2, L3 are performed by changing the projected heights of the projection portions at the second end portions E2 of the fourth mirrors 12Y, 12M, 12C.

Figure 9:
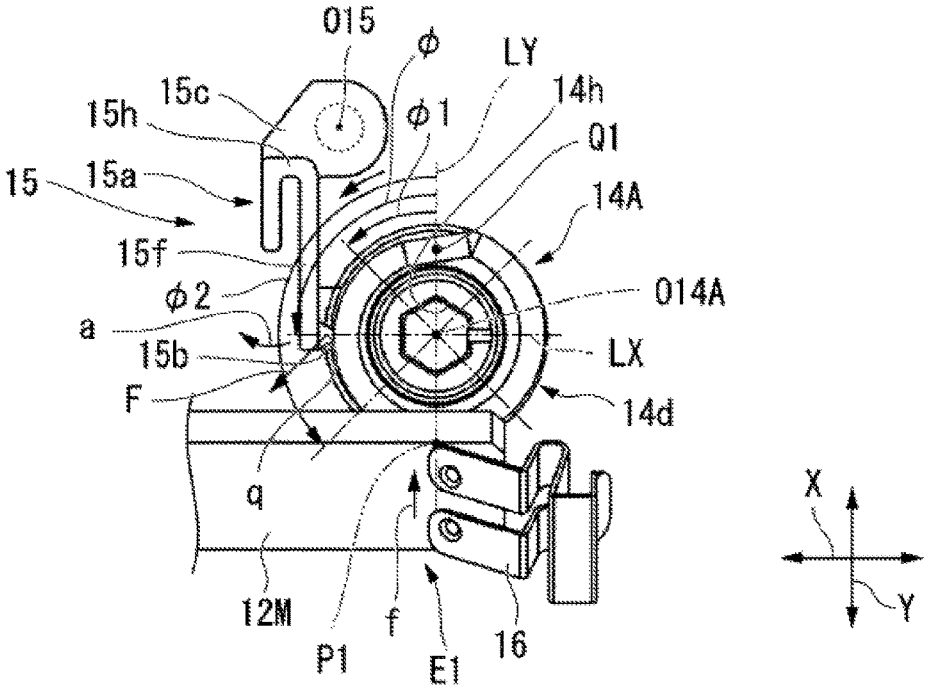
FIG. 9 is a plan view schematically showing an action of the image forming apparatus of the embodiment.
Figure 10:
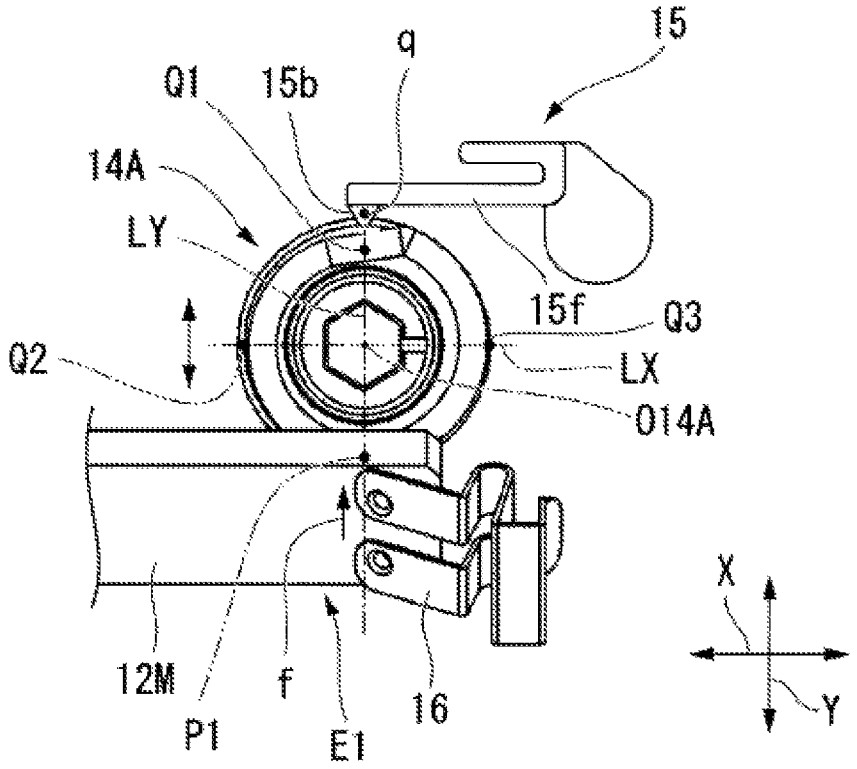
PRIOR ART Fig.10
FIG. 10 is a plan view schematically showing an action of an image forming apparatus of a comparative example.

To begin with, an operation of the swing adjustment using the first rotating cam 14A will be described, in the example of the fourth mirror 12M. FIG. 9 is a plan view schematically showing an action of the image forming apparatus of the embodiment. FIG. 10 is a plan view schematically showing an action of an image forming apparatus of a comparative example.

As shown in FIG. 9, in the present embodiment, the engagement portion 15*b* of the stopper 15 is engaged with the first concave-convex portion 14*d* of the first rotating cam 14A. Unless the engagement portion 15*b* moves to the engagement release position, the first rotating cam 14A does not rotate around the central axis line O14A. As shown in FIG. 6, the rear surface 12*b* of the fourth mirror 12M makes contacts with the first cam portion 14*c*, the support projection 11C at two points of the points P1, P2, respectively. The reflection surface 12*a* of the fourth mirror 12M is pressed to the rear surface 12*b* side by the presser spring 16. A tilt angle of the reflection surface 12*a* of the fourth mirror 12M in the YZ plane is determined by a tilt angle of a straight line connecting the points P1, P2. When the first rotating cam 14A rotates around the rotation central axis line O14A, the position of the point P1 in the Y direction changes. For example, if the distance rp form the central axis line O14A to the point P1 increases (decreases), the tilt angle of the reflection surface 12*a* to the horizontal plane increases (decreases).

In the present embodiment, in order to rotate the first rotating cam 14A, an adjuster engages an adjustment jig not shown in the drawing with the adjustment jig engagement hole 14*b*, or the adjustment jig engagement hole 14*f* (refer to FIG. 6). The adjuster rotates the adjustment jig around the central axis line O14A. For example, the adjuster rotates the adjustment jig in the counterclockwise direction, in FIG. 9. At this time, a pressing force F from the teeth of the first concave-convex portion 14*d* with which the engagement portion 15*b* contacts acts on the engagement portion 15*b*.

A moment in the clockwise direction shown in the drawing acts on the base end portion of the arm portion 15*f*, by the pressing force F. Having received the moment by the pressing force F, the arm portion 15*f* bends in the clockwise direction shown in the drawing in the XY plane. An elastic restoring force caused by the bending of the arm portion 15*f* is applied to the first rotating cam 14A, as a resistance force. The adjuster continues the rotation by a force larger than the resistance force, and thereby the arm portion 15*f* further bends. The engagement portion 15*b* moves in the direction of an arrow a along the contact surface with the first concave-convex portion 14*d*. When the apex portion of the engagement portion 15*b* reaches the apex portion of the tooth of the first concave-convex portion 14*d*, the engagement by the engagement portion 15*b* in the circumferential direction is released. At this time, the reaction force in the circumferential direction by the engagement portion 15*b* becomes only a friction force generated by the contact of the apex portions themselves. The resistance force from the engagement portion 15*b* enormously decreases than that in the engagement position. The adjuster can further rotate the first rotating cam 14A in the clockwise direction shown in the drawing.

In this manner, the engagement portion 15*b* gets over the apex portion of the convex portion of the first concave-convex portion 14*d*. The engagement portion 15*b* faces the concave portion of the first concave-convex portion 14*d*. At this time, the engagement portion 15*b* is biased toward the central axis line O14A by the arm portion 15*f*. The engagement portion 15*b* comes in the concave portion of the first concave-convex portion 14*d*. The engagement portion 15*b* engages with a concave portion next to the concave portion of the engagement position at the time of starting the rotation, in the first concave-convex portion 14*d*. In this manner, the first rotating cam 14A rotates in the clockwise direction shown in the drawing, by one pitch portion of the first concave-convex portion 14*d*. The adjuster repeats the rotation action like this, and thereby can perform alignment of the rotation position of the first rotating cam 14A. It is possible to perform alignment of the rotation position of the first rotating cam 14A by each pitch of the convex portion or the concave portion in the first concave-convex portion 14*d*. When the adjuster stops the rotation of the adjustment jig, the engagement portion 15*b* moves to the engagement position in the concave portion of the nearest first concave-convex portion 14*d*. The rotation position of the first rotating cam 14A is fixed, by the engagement portion 15*b* engaged with the first concave-convex portion 14*d* at the engagement position. The operation in the clockwise direction shown in the drawing has been described, but the operation in the counterclockwise direction is the same.

As shown in FIG. 6, while the first rotating cam 14A is rotated, the first rotating cam 14A receives a pressing force f at the point P1 in the YZ plane. A Y direction component of the pressing force f is a force to press the first rotating cam 14A to the engagement portion 15*b* side in the Y direction. The first concave-convex portion 14*d* of the first rotating cam 14A moves to the engagement portion 15*b* side, by the Y direction component of the pressing force f, within the range of a gap between the second shaft portion 14*e* and the bearing portion 11*a*. In order to smoothly rotate the first rotating cam 14A to perform adjustment, it is necessary that the outer diameter of the second shaft portion 14*e* is made smaller than the inner diameter of the bearing portion 11*a*. A gap is inevitably generated between the second shaft portion 14*e* and the bearing portion 11*a*.

A z direction component of the pressing force f forms a moment to rotate the first rotating cam 14A in the clockwise direction shown in the drawing. The first cam portion 14*c* rotates in the clockwise direction shown in the drawing, by the moment caused by the Z direction component of the pressing force f. The first cam portion 14*c* rotates within the range of the gap between the second shaft portion 14*e* and the bearing portion 11*a*. As a result of this, the first cam portion 14*c* sinks more downward shown in the drawing at the point P1 than the case that the pressing force f does not act on. The first cam portion 14*c* floats more upward shown in the drawing at a point Q1 opposite to the point P1 with the central axis line O14A interposed therebetween than the case that the pressing force f does not act on.

The position of the first concave-convex portion 14*d* below the points P1, Q1 moves in the Z direction, in the same manner as the points P1, Q1. The magnitude of the movement amount of the first concave-convex portion 14*d* in the Z direction increases in proportion to the distance from the central axis line O14A in the X direction. The magnitude of the movement amount thereof in the Z direction becomes maximum, below the points P1, Q1. As shown in FIG. 9, a straight line, seen from the Z direction, connecting the central axis line O14A (the rotating shaft line of the first rotating cam) and the point P1 (the contact position) is made to be a straight line LY. A straight line which passes through the central axis line O14A and is orthogonal to the straight line LY, seen from the Z direction, is made to be a straight line LX. An orientation of a position q (engagement position) where the engagement portion 15*b* is engaged on the circumference where the first concave-convex portion 14*d* is located, is expressed by a magnitude of a central angle $\phi$ (here, $0° \leq \phi \leq 180°$) measured from the point Q1 side on the straight line LY. The central angle $\phi$ may be measured in any direction of the clockwise direction shown in the drawing, and the counterclockwise direction shown in the drawing. The central angle $\phi$ is a crossing angle of a line connecting the position q and the central axis line O14A, and the straight line LY, seen from the Z direction. The point q is an intersection point of the pitch circle of the first concave-convex portion 14*d* and the central line of the tooth of the engagement portion 15*b*, seen from the Z direction. The magnitude of the movement amount of the first concave-convex portion 14*d* in the Z direction becomes maximum, when $\phi=0°$ and $\phi=180°$. The magnitude of the movement amount of the first concave-convex portion 14*d* in the Z direction becomes minimum, when $\phi=90°$. In the present embodiment, since the engagement portion 15*b* engages on the straight line LX, the orientation of the position q is, as $\phi=90°$.

For example, a case that the stopper 15 is arranged as in a comparative example shown in FIG. 10 will be considered. In this comparative example, the engagement portion 15*b* is arranged at a position on the straight line LY passing through the central axis line O14A and the contact portion (the point P1) with the fourth mirror 12M in the first rotating cam 14A, seen from the rotating shaft direction of the first rotating cam 14A. The central axis line O14A is the rotating shaft line of the first rotating cam 14A.

In this comparative example, the engagement portion 15*b* engages with the first concave-convex portion 14*d* below the point Q1. The orientation of the position q where the engagement portion 15*b* of the comparative example engages with the first concave-convex portion 14*d* is, as $\phi=0°$. In this case, the first concave-convex portion 14*d* of the comparative example is shifted in the Z direction than a design engagement position with the engagement portion 15*b*. A position shift amount of the first concave-convex portion 14*d* in the Z direction is maximum. The engagement portion 15*b* and the first concave-convex portion 14*d* deviate from the design contact surface. The engagement portion 15*b* and the first concave-convex portion 14*d* obliquely engage with each other. The resistance force from the engagement portion 15*b* at the time of rotating the first rotating cam 14A increases, by the engagement like this. It becomes difficult for an adjuster to rotate the rotating cam 14A. When the adjuster further rotates the first rotating cam 14A against the resistance force in this state, the engagement portion 15*b* and the first concave-convex portion 14*d* may be mutually damaged. Further, the engagement portion 15*b* and the first concave-convex portion 14*d* may be plastically deformed. Further, the arm portion 15*f* may be plastically deformed, by the external force acting on the arm portion 15*f* from the first concave-convex portion 14*d*. When a damage such as plastic deformation is generated in the first concave-convex portion 14*d* or the stopper 15, the first concave-convex portion 14*d* and the stopper 15 become impossible to keep the normal engagement. The stopper 15 becomes impossible to hold the position of the first rotating cam 14A at the time of the adjustment.

Further, in the above-described comparative example, the first concave-convex portion 14*d* has further moved in the Z direction than the design position. An amount of engagement of the engagement portion 15*b* and the first concave-convex portion 14*d* is smaller than the design amount of engagement. As a result of this, the engagement portion 15*b* is easy to be disengaged from the first concave-convex portion 14*d*. When the engagement portion 15*b* is disengaged from the first concave-convex portion 14*d*, the first concave-convex portion 14*d* and the stopper 15 become impossible to keep the normal engagement. The stopper 15 becomes impossible to hold the position of the first rotating cam 14A at the time of the adjustment.

Further, in the case of the comparative example, the first rotating cam 14A is pressed toward the engagement portion 15*b* by the Y direction component of the pressing force f. As a result of this, there is a problem that a force necessary for rotating the first rotating cam 14A becomes further large.

As shown in FIG. 9, in the present embodiment, the engagement portion 15*b* engages with the first concave-convex portion 14*d* on the straight line LX orthogonal to the straight line LY. Even if the first rotating cam 14A receives the pressing force f on the straight line LX, the movement amount of the first concave-convex portion 14*d* of the first rotating cam 14A in the Z direction is minimum. As a result of this, in the present embodiment, the engagement of the engagement portion 15*b* and the first concave-convex portion 14*d* is smooth, compared with the above-described comparative example. Compared with the above-described comparative example, the resistance force from the stopper 15 at the time of rotating the first rotating cam 14A is smaller. In the present embodiment, the engagement portion 15*b*, the arm portion 15*f*, and the first concave-convex portion 14*d* are hard to cause a damage such as plastic deformation. The stopper 15 can hold the position of the first rotating cam 14A at the time of the adjustment.

Next, an operation of a tilt adjustment using the second rotating cam 14B will be described. Though not shown particularly in the drawing, the first end portion E1 of the fourth mirror 12K is supported at two points by the first rotating cam 14A and a projection portion, not shown in the drawing, similar to the support projection 11C. These two support points are called the points P1, P2, in the same manner as the case of the fourth mirror 12M. The points P1, P2 are points where the first rotating cam 14A and the above described projection portion not shown in the drawing make contact with the first end portion E1 of the fourth mirror 12K, respectively. The second end portion E2 of the fourth mirror 12K is supported at one point by the second rotating cam 14B at the point P4, as shown in FIG. 8. The point P4 is a point where the second rotating cam 14B makes contact with the second end portion E2 of the fourth mirror 12K.

The adjuster can rotate the second rotating cam 14B in the same manner as the above-described first rotating cam 14A. When the adjuster rotates the second rotating cam 14B around the central axis line O14B, the point P4 moves in the Y direction by an action of the second cam portion 14*h*. The side surface 12*c* of the fourth mirror 12K is locked by the locking projection 11D. The side surface 12*c* can slide with respect to the locking projection 11D. For example, the distance Rp from the central axis line O14B to the point P4 increases, by the rotation of the second rotating cam 14B. A pressing force g acts on the rear surface 12*b* from the point P4. The pressing force g resists against a pressing force G of the presser spring 16. When the pressing force g exceeds a resultant force of the pressing force G and a friction force acting on the side surface 12*c*, the fourth mirror 12K moves in the direction of an arrow b. At this time, the point P4 that is the contact portion of the second cam portion 14*h* and the rear surface 12*b* moves near the side surface 12*c* in the short direction of the rear surface 12*b*. This is equivalent to that the fourth mirror 12K has moved upward shown in the drawing by the second cam portion 14*h*, when seen in the YZ cross section passing through the point P4. At this time, the tilt angle of the fourth mirror 12K in the YZ plane is equal to the tilt angle determined by the position of the first rotating cam 14A, at the first end portion E1 not shown in the drawing.

As can be understood from the above-described operation, the fourth mirror 12K is rotated around the straight line connecting the points P1, P2 not shown in the drawing in the first end portion E1, by the rotation of the second rotating cam 14B. The movement of the fourth mirror 12K by the second rotating cam 14B corresponds to changing a tilt angle of the fourth mirror 12K in the ZX plane. When the fourth mirror 12K is moved by the second rotating can 14B, a reflection position of the laser beam L4 on the reflection surface 12*a* gradually changes from the first end portion E1 toward the second end portion E2. The laser beam L4 reflected by the fourth mirror 12K moves on the surface of the photoreceptor drum 25*k* in the sub scanning direction. The magnitude of the movement amount in the sub scanning direction gradually increases from the first end portion E1 side toward the second end portion E2 side. As a result of this, it is possible to adjust the tilt of the scanning line on the photoreceptor drum 25*k*, by rotating the second rotating cam 14B.

In the tilt adjustment using the second rotating cam 14B, the engagement portion 15*b* of the stopper 15 engages with the second concave-convex portion 14*i* as a second engagement portion. An engagement position of the engagement portion 15*b* to engage with the second concave-convex portion 14*i* is the same position as the case in the first rotating cam 14A. An action of the stopper 15 in the tilt adjustment using the second rotating cam 14B is the same as the case of the swing adjustment using the first rotating can 14A. In the present embodiment, the engagement portion 15*b*, the arm portion 15*f*, and the second concave-convex portion 14*i* are hard to cause a damage such as plastic deformation, at the time of rotating the second rotating cam 14B. The stopper 15 can hold the position of the second rotating cam 14B at the time of the adjustment.

According to the image forming apparatus 100 of the present embodiment, the first concave-convex portion 14*d* of the first rotating cam 14A and the second concave-convex portion 14*i* of the second rotating cam 14B are engaged with the respective engagement portions 15*b*. As shown in FIG. 9, the engagement position of the engagement portion 15*b* to engage with the first concave-convex portion 14*d* (the second concave-convex portion 14*i*) is a position of an orientation of $\phi=90°$ on the first concave-convex portion 14*d* (the second concave-convex portion 14*i*). The position q in the present embodiment is different from a position on the straight line LY. The straight line LY is a straight line passing through the rotating shaft line, and the point P1 (P4) that is the contact portion with the mirror in the first rotating cam 14A (the second rotating cam 14B), seen from the rotating shaft line direction of the first rotating cam 14A (the second rotating cam 14B). The image forming apparatus 100 has the engagement portion 15*b* as described above. In the image forming apparatus 100, the adjustment of the mirror is easily performed, and the adjustment position is hard to be shifted.

Hereinafter, a modification of the above-described embodiment will be described. In the description of the above-described embodiment, the case that the engagement portion 15*b* engages with the first concave-convex portion 14*d* (the second concave-convex portion 14*i*) at the position of the orientation of $\phi=90°$ has been described. But, if the engagement position of the engagement portion 15*b* and the first concave-convex portion 14*d* (the second concave-convex portion 14*i*) is a position except a position on the straight line LY, seen from the rotating shaft direction of the first rotating cam 14A (the second rotating cam 14B), the engagement position is not limited to the position of the orientation of $\phi=90°$. If a position of an orientation of $\phi=0°$ or $\phi=180°$ is excluded, it is possible to avoid at least a position where the movement amount of the first concave-convex portion 14*d* (the second concave-convex portion 14*i*) in the Z direction becomes maximum. In this case, compared with a case that the engagement portion 15*b* and the first concave-convex portion 14*d* (the second concave-convex portion 14*i*) are engaged with each other at the position of the orientation of $\phi=0°$ or $\phi=180°$, the adjustment of the mirror is more easily performed, and the adjustment position is harder to be shifted. As the magnitude of $\phi$ is nearer to 90°, the adjustment of the mirror is more easily performed, and the adjustment position is harder to be shifted. The magnitude of $\phi$ can appropriately be set in the range that $0°<\phi1\leq\phi\leq\phi2<180°$. For example, $\phi$ may be set such that $\phi1=45°$, $\phi2=135°$. For example, in order to make the movement amount of the first concave-convex portion 14*d* (the second concave-convex portion 14*i*) in the Z direction to be a half of the maximum value, it is only necessary to set $\phi$ such that $\phi1=60°$, $\phi2=120°$.

In the description of the above-described embodiment, the example of the case to perform the swing adjustment and the tilt adjustment of the fourth mirror has been described. But regarding the swing adjustment and the tilt adjustment, only any one of them may be performed to the one mirror. Further, a mirror to which at least one of the swing adjustment and the tilt adjustment is to be performed can be selected from the all mirrors in the image forming apparatus 100, if necessary. For example, the mirror to be adjusted is not limited to a mirror at a side nearest to the photoreceptor drum, on the optical path of the optical scanning beam.

In the description of the above-described embodiment, the example that the first concave-convex portion 14*d* and the second concave-convex portion 14*i* are formed of the spur gear tooth form of the same module has been described. As a result of this, the stoppers 15 can be commonly used. However, pitches of the convex portions or the concave portions of the first concave-convex portion 14*d* and the second concave-convex portion 14*i* may be different to each other. When spur gear tooth forms are used as concave-convex shapes, modules of the spur gear tooth forms may be different. In this case, the shapes of the first engagement portion and the second engagement portion are made different from each other, in accordance with the difference of the concave-convex shapes.

According to at least the one embodiment as described above, an image forming apparatus has a stopper including an engagement portion, and thereby it is possible to provide an image forming apparatus in which adjustment of a mirror is easily performed, and an adjustment position is hard to be shifted. The engagement portion of the stopper engages with a concave-convex portion of a rotating cam, at a position except a position on a straight line passing through a rotating shaft line of the rotating cam and a contact portion with a mirror in the rotating cam, seen from the rotating shaft direction of the rotating cam.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus which exposes a photoreceptor to form an electrostatic latent image on the photoreceptor and develops the electrostatic latent image to form an image, the image forming apparatus comprising:

a mirror which reflects an optical scanning beam toward the photoreceptor so as to expose the photoreceptor;

a rotating member which makes contact with the mirror at an end portion of the mirror to support the mirror, and rotates to perform swing adjustment of the mirror; and a stopper which engages with the rotating member, at a position different from a position on a straight line passing through a rotating shaft line of the rotating member and a contact position of the rotating member and the mirror, as seen from a rotating shaft direction of the rotating member, to fix a rotation position of the rotating member.

2. The image forming apparatus according to claim 1, further comprising:

a pressing member to press the mirror toward the rotating member.

3. The image forming apparatus according to claim 1, wherein:

the rotating member has a concave-convex portion formed on a circumference around the rotating shaft line; and the stopper has an engagement portion to engage with the concave-convex portion.

4. The image forming apparatus according to claim 3, wherein:

the concave-convex portion has a gear tooth form.

5. The image forming apparatus according to claim 3, wherein:

the stopper has an elastic portion to bias the engagement portion toward the concave-convex portion.

6. The image forming apparatus according to claim 3, wherein:

the concave-convex portion and the engage portion engage with each other so that a crossing angle of a line connecting an engagement position of the engagement portion and the concave-convex portion and the rotating shaft line of the rotating member, and the line connecting the rotating shaft line of the rotating member and the contact position becomes not less than 45°, and not more than 135° as seen from the rotating shaft direction of the rotating member.

7. The image forming apparatus according to claim 1, wherein the rotating member includes:

a first rotating member which makes contact with the mirror at a first end portion of the mirror to support the mirror, and rotates to perform swing adjustment of the mirror; and a second rotating member which makes contact with the mirror at a second end portion of the mirror to support the mirror, and rotates to change a tilt angle of the mirror.

8. The image forming apparatus according to claim 7, wherein the stopper includes:

a first stopper which engages with the first rotating member, at a position different from a position on a straight line passing through a rotating shaft line of the first rotating member and a contact position of the first rotating member and the mirror, as seen from a rotating shaft direction of the first rotating member, to fix a rotation position of the first rotating member; and a second stopper which engages with the second rotating member, at a position different from a position on a straight line passing through a rotating shaft line of the second rotating member and a contact position of the second rotating member and the mirror, as seen from a rotating shaft direction of the second rotating member, to fix a rotation position of the second rotating member.

9. The image forming apparatus according to claim 8, wherein:

the first rotating member has a first concave-convex portion formed on a circumference around the rotating shaft line of the first rotating member; and the first stopper has a first engagement portion to engage with the first concave-convex portion.

10. The image forming apparatus according to claim 9, wherein:

the second rotating member has a second concave-convex portion formed on a circumference around the rotating shaft line of the second rotating member; and the second stopper has a second engagement portion to engage with the second concave-convex portion.

11. The image forming apparatus according to claim 7, wherein:

the first rotating member rotates to perform swing adjustment of the mirror for aligning a scanning line of the optical scanning beam with a target position on the photoreceptor; and the second rotating member rotates to change the tilt angle of the mirror for adjusting a tilt of the scanning line of the optical scanning beam.

12. The image forming apparatus according to claim 1, wherein:

the rotating member has an outer shape with a radius from the rotating shaft line spirally changing around the rotating shaft line.

13. The image forming apparatus according to claim 1, wherein the photoreceptor includes:

a first photoreceptor on which a black image is formed, and a second photoreceptor on which an image having a color other than black is formed, and wherein the mirror includes:

a first mirror which reflects a first optical scanning beam for forming the black image toward the first photoreceptor, and a second mirror which reflects a second optical scanning beam for forming the image having the color other than black toward the second photoreceptor.

14. The image forming apparatus according to claim 13, wherein the rotating member includes:

a first rotating member which makes contact with the first mirror at a first end portion of the first mirror to support the first mirror, and rotates to perform swing adjustment of the first mirror for aligning a scanning line of the first optical scanning beam with a target position on the first photoreceptor;

a second rotating member which makes contact with the first mirror at a second end portion of the first mirror to support the first mirror, and rotates to change a tilt angle of the first mirror for adjusting a tilt of the scanning line of the first optical scanning beam;

a third rotating member which makes contact with the second mirror at a first end portion of the second mirror to support the second mirror, and rotates to perform swing adjustment of the second mirror for aligning a scanning line of the second optical scanning beam with a target position on the second photoreceptor; and a support member which makes contact with the second mirror at a second end portion of the second mirror to support the second mirror, the support member having a support projection with a predetermined height for adjusting a tilt of the scanning line of the first optical scanning beam.

15. The image forming apparatus according to claim 14, wherein the stopper includes:

a first stopper which engages with the first rotating member, at a position different from a position on a straight line passing through a rotating shaft line of the first rotating member and a contact position of the first rotating member and the first mirror, as seen from a rotating shaft direction of the first rotating member, to fix a rotation position of the first rotating member;

a second stopper which engages with the second rotating member, at a position different from a position on a straight line passing through a rotating shaft line of the second rotating member and a contact position of the second rotating member and the first mirror, as seen from a rotating shaft direction of the second rotating member, to fix a rotation position of the second rotating member; and a third stopper which engages with the third rotating member, at a position different from a position on a straight line passing through a rotating shaft line of the third rotating member and a contact position of the third rotating member and the second mirror, as seen from a rotating shaft direction of the third rotating member, to fix a rotation position of the third rotating member.

16. The image forming apparatus according to claim 1, wherein a distance from the rotating shaft line of the rotating member to the contact position of the rotating member and the mirror changes according to the rotation of the rotating member.

17. The image forming apparatus according to claim 1, wherein a tilt angle of the mirror changes according to the change in the distance from the rotating shaft line of the rotating member to the contact position of the rotating member and the mirror.

* * * * *